United States Patent [19]

Burger et al.

[11] Patent Number: 4,813,699

[45] Date of Patent: Mar. 21, 1989

[54] SKI

[75] Inventors: Wolfgang Burger, Wernau; Gert Wloka, Ostfildern; Helmut Sommer, Reichenbach, all of Fed. Rep. of Germany

[73] Assignee: Feldmuehle Aktiengesellschaft, Duesseldorf, Fed. Rep. of Germany

[21] Appl. No.: 62,224

[22] Filed: Jun. 11, 1987

[30] Foreign Application Priority Data

Jun. 14, 1986 [DE] Fed. Rep. of Germany ..... 3620078

[51] Int. Cl.[4] ..... A63C 5/00

[52] U.S. Cl. ..... 280/610; 428/432; 428/698

[58] Field of Search ..... 428/432, 698; 280/610, 280/609, 601

[56] References Cited

U.S. PATENT DOCUMENTS 3,395,928 8/1968 Eglit ..... 280/610
4,312,899 1/1982 Lahmann ..... 428/698
4,406,668 9/1983 Sarin ..... 428/698 X
4,702,970 10/1987 Sarin et al. ..... 428/698 X

FOREIGN PATENT DOCUMENTS 230570 12/1984 Japan .
190187 6/1937 Switzerland .
271670 10/1951 Switzerland .

OTHER PUBLICATIONS

Ski Magazine, Dec. 1986, pp. 116, 117.

*Primary Examiner*—David M. Mitchell
*Assistant Examiner*—Michael Mar
*Attorney, Agent, or Firm*—Felfe & Lynch

[57] ABSTRACT

A ski having good glidability, and low wear in its glide zones, and in which the tread areas in the glide zones are so configured that ordinary flexural stress will not ensue in cracking or other damage to the thread. The ski has a glide surface comprising one or more elements which are in the form of at least one of solid ceramic sintered compacts and coated metal base plates.

5 Claims, 4 Drawing Sheets

SKI

The present invention relates to a ski.

Ordinary skis have glide zones, one at the front behind the tip of the ski and one at the tail of the ski. In the unloaded state only these glide zones are in contact with the snow or ice covered ground. Not until a shift of the weight of the skier occurs do the areas of the ski tread underneath the ski boot come in contact with the ground. Considering this, the quality of the glide zones is an important factor in the "glidability" of the ski and is one of the factors that determines the achievable velocities, especially in downhill skiing, where the lowest possible friction is desired between the glide zones and the ground. The effort is therefore made to keep the entire tread of the ski, but especially the glide zones, in a perfect state for the attainment of high velocities.

However, damage to the tread and to the edging of the ski as a result of severe use is unavoidable, so that constant inspection and repair, especially of the glide zones, is indispensable. In the case of ski bodies which are usually made in a sandwich-like construction, the tread of the ski, especially in the bearing area, is repaired by overlaying it with special repair patches and welding the latter to the ski tread.

Another disadvantage that occurs due to the light construction commonly employed in skis today is "fluttering" of the front of the ski, which occurs especially at high speeds.

U.S. Pat. No. 3,395,928 discloses a ski in which the entire tread has a porcelain-enamel coating which is applied to a metal plate bonded to the wooden ski body. The wear resistance of this known coating, however, is very poor, and the danger also exists that the flexural stress applied in the use of the ski may result, due to the broad area of its application to the entire bottom, in the spalling, or at least in the cracking, of the coating.

According to a very old proposal made in Swiss Patent No. 190, 187, in a ski whose body consists of metal, tracks of wood are inlaid in the tread. This does reduce the weight of the ski, but at the same time the wear resistance of the portions of the tread that consist of wood is lower.

The form-locking fastening to a wooden ski of a metal tread extending over the entire bottom is disclosed in Swiss Patent No. 271,670. A suitable holding means is said to bring it about that the tread consisting preferably of light metal will be displaceable relative to the wooden ski body. Due to the constant stress of the holding means, the danger is created that the tread will come loose from the ski body, and another disadvantage is the poor wear resistance of metal alloys, especially of aluminum.

The invention addresses itself to the problem of making a ski available which will have good glidability, and low wear in its glide zones, and in which the tread areas within the glide zones will be so configured that ordinary flexural stress will not ensue in cracking or other damage to the tread.

By the configuration of the elements proposed according to the invention, and due to the favorable coefficient of friction between snow and ice and the ceramic materials of the compacts or the titanium compounds and ceramic materials proposed as coatings, lower friction is produced in the glide zones exposed to the greatest friction and severest stresses, so that the achievement of higher velocities is possible. In consequence of the extraordinarily great hardness and strength of the solid ceramic sintered compacts, especially in the case of the titanium compounds intended for the coating, the common mending heretofore practiced in the area of the glide zone is eliminated, along with the sharpening or reconditioning required in the case of the common metal ski edging. It has also been found that, through the use of the elements provided according to the invention, even though they are of relatively small dimensions, a decided improvement of the torsional strength is achieved.

Suitable ceramic materials for making the elements in the form of sintered compacts are partially stabilized zirconium oxide of the PSZ or TZP type, aluminum oxide, silicon carbide, silicon nitride or silicon aluminum oxynitride. Particularly zirconium oxide has proven to be quite especially suitable, since this material provides especially good gliding qualities on snow and ice, besides having an especially high ultimate flexural strength and toughness at rupture, a relatively high impact strength, and yet a certain elasticity. Aluminum oxide is preferred especially from economical points of view and also permits the production of especially complex forms. Furthermore, aluminum oxide has a relatively great hardness. Silicon carbide is preferred on account of its light specific weight. Additional advantages lie in the extraordinarily great hardness and in the low RA value (arithmetical average surface roughness). Desirable gliding qualities are thus achieved. Silicon carbide sintered without pressure or hot-pressed silicon carbide is preferred.

The advantages of silicon nitride are to be found also in its low specific weight, its high ultimate flexural strength and its high resistance to wear. Pressure-less sintered silicon nitride is especially suitable. An especially preferred embodiment of the invention provides that the glide surfaces are made from elements in the form of solid-ceramic, foliar sintered compacts, the sintered compacts having thicknesses in the range of 0.5 to 1.5 mm. Preferably the thickness is even less, and is about 0.8 to 1.2 mm. Such foliar sintered compacts are made by forming, e.g., by casting and then stamping out from a mass which consists especially of a temporary organic binding agent, and otherwise of the ceramic material of aluminum oxide, zirconium oxide, silicon carbide, silicon nitride or silicon aluminum oxynitride. After shaping, the organic binding agent is burned out, the greenware is sintered, then ground, and the finished sintered compact is bonded to the ski, preferably by cementing. Then the bottom of the ski is ground flush so that all parts of the bottom are in one plane. This embodiment is preferred because it makes it possible with relatively thin and therefore very light sintered compacts to form, in the glide zones of a ski, surfaces which, due to the great hardness of the sintered insert, have an extraordinarily good resistance to wear and outstanding glidability. This embodiment is characterized furthermore by good flexibility of the ski body.

The elements can be fastened to the ski bottom preferably by bonding and/or interlocking. If elements are used which are either in the form of solid ceramic sintered compacts, but are not foliar, or if metal base plates coated according to the invention are used, such elements can best be provided with grooves, dovetails, studding or recesses. Fastening the elements on by cementing has proven to be especially appropriate.

By means of elements which are in the form of solid ceramic sintered compacts but are not foliar an especially high torsional strength can be achieved, especially if elements of a thickness of 3 to 6 millimeters are used.

If the elements consist of metal base plates coated with the titanium compounds and ceramic materials, the advantage is that it is possible to configure the elements in virtually any desired geometry, thus providing many different possibilities for the achievement of an especially firm bond. The coating is applied to the metal base plates preferably only on the bottom face thereof, while of course the metal is to be matched to the coating substances, especially with regard to their coefficients of thermal expansion.

The embodiment specified in which the elements 20, 21, 22, 23, 24, 25 (described subsequently) are so arranged that the reinforcing edges 5 are formed in the area of the glide zones 3, 3*a* of those elements is preferred because a greatly improved resistance to wear is achieved also in the area of the ski edging.

On the other hand, the embodiment in which the elements 20, 21, 22, 23, 24, 25 are so arranged that between them and the reinforcing edges 5 no distance or only a minimal distance (A) exists offers the advantage that the conventional production method of installing ski edging can be retained in the manufacture of the skies.

It has proven advantageous to provide a plurality of elements in each of the front and rear glide zones of the ski. To assure sufficient flexibility when the ski flexes, i.e., to prevent the elements from rubbing against one another, the elements are inserted at a slight distance apart; the distance apart (A) of 2/10 to 4/10 mm as measured at the tread in the direction of ski movement, has proven especially appropriate.

An especially appropriate embodiment is offered with two elements (20, 21, 22, 23, 24, 25) disposed one behind the other in the glide zones (3, 3*a*), as seen in the running direction. With two elements it is possible to cover a sufficient area within the glide zones, the width of each of the elements, measured lengthwise of the ski, being 65 to 95 mm. especially about 80 mm. Making the elements of this width, however, not only permits the formation of a sufficiently large glide zone, but also permits a sufficiently great flexure of the ski in the direction approximately perpendicular to the tread of the ski.

Additional embodiments provide that the elements, preferably those which are in the glide zone adjacent the tip of the ski, are crowned on the bottom to match the tread of the ski, and preferably are spherically curved on their bottom at the tread, and that the elements adjacent the rear glide zone have a groove like that on the tread.

The term, "tread," used in the claims and description of the present invention, can, in the case of a ski composed sandwich-wise of a plurality of layers, be interpreted to mean also those layers which are further inside of the ski above the outer layer of the tread.

In accordance with the invention, a ski comprises at least one of a forward and rearward glide zone with a glide surface of ceramic material and which comprises one or more elements which are in the form of at least one of solid ceramic sintered compacts and metal base plates which are coated with at least one material of the group consisting of aluminum oxide, zirconium oxide, silicon carbide, silicon nitride, silicon aluminum oxynitride, titanium carbide, titanium nitride, and a titanium carbonitride of the general formula $Ti(C_x, N_{1-x})$, wherein $x=0$ to 1.

For a better understanding of the present invention, together with other and further objects thereof, reference is made to the following description, taken in connection with the accompanying drawings, and its scope will be pointed out in the appended claims.

Referring now to the drawings.

Figure 1:
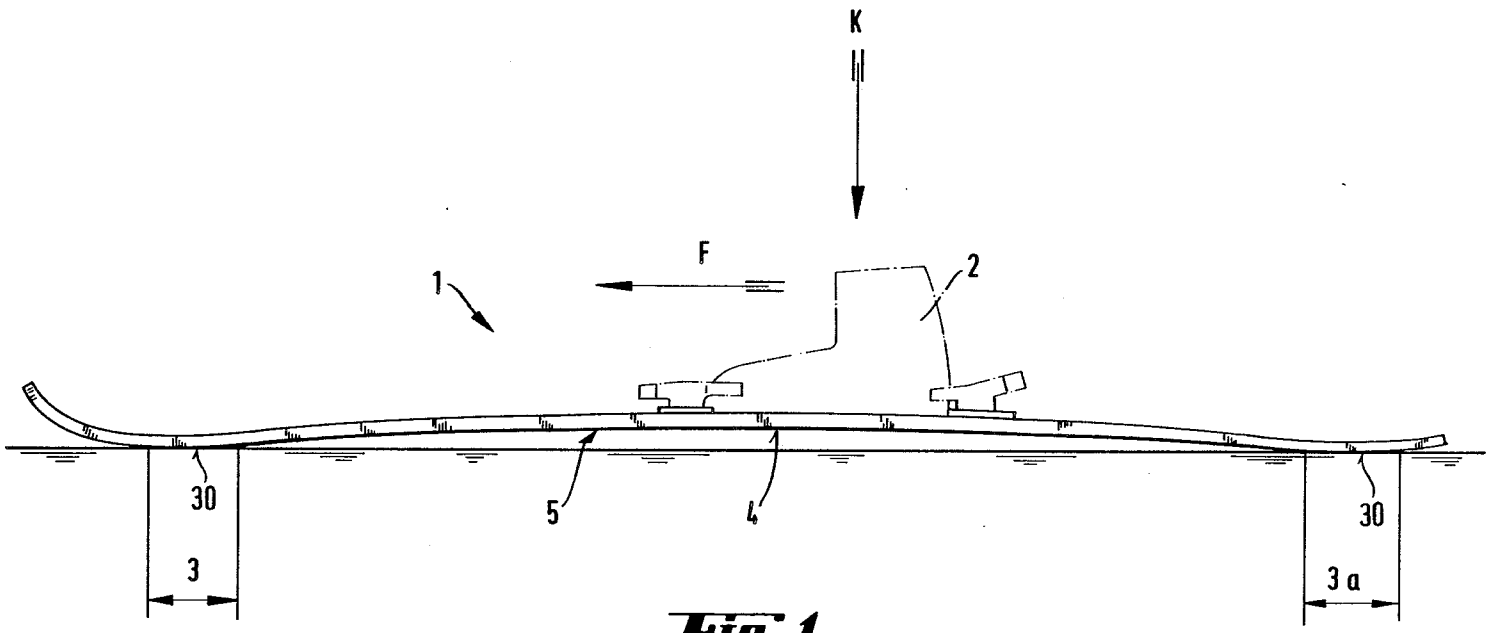
FIG. 1 is a side elevation of a ski according to the invention.

In the ski 1 shown in FIG. 1 it can be seen that the forces exerted in the direction of the arrow K in the area of the ski boot 2 result primarily in a pressure in the glide zones 3 and 3*a*. The direction of movement F of the ski is indicated by an arrow as in the rest of the figures. The glide surfaces 30 are disposed in the glide zones 3 and 3*a*.

Figure 2:
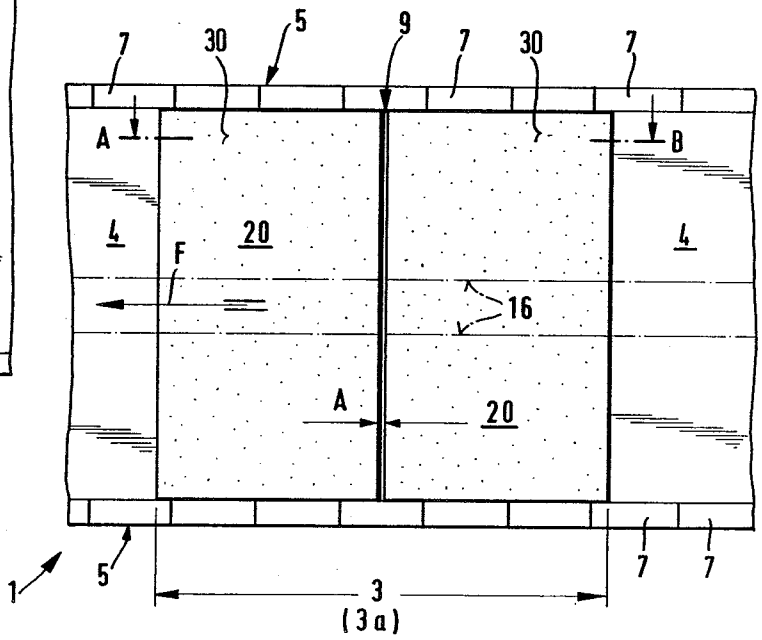
FIG. 2 is a fragmentary bottom view of a ski according to the invention.

In FIG. 2 there is shown a ski 1 having an edging 5 formed of individual segments 7, a tread 4, and elements 20 disposed in the glide zone 3 and forming the glide surfaces 30. The elements 20 reach as far as the inner contour of the edging 5, and between the elements 20 there is a space A between their confronting edges 9, which, measured at the tread, amounts to, for example, 0.35 mm. In the center of the tread 4 and of the glide zone 3*a* there is a groove 16.

Figure 3:
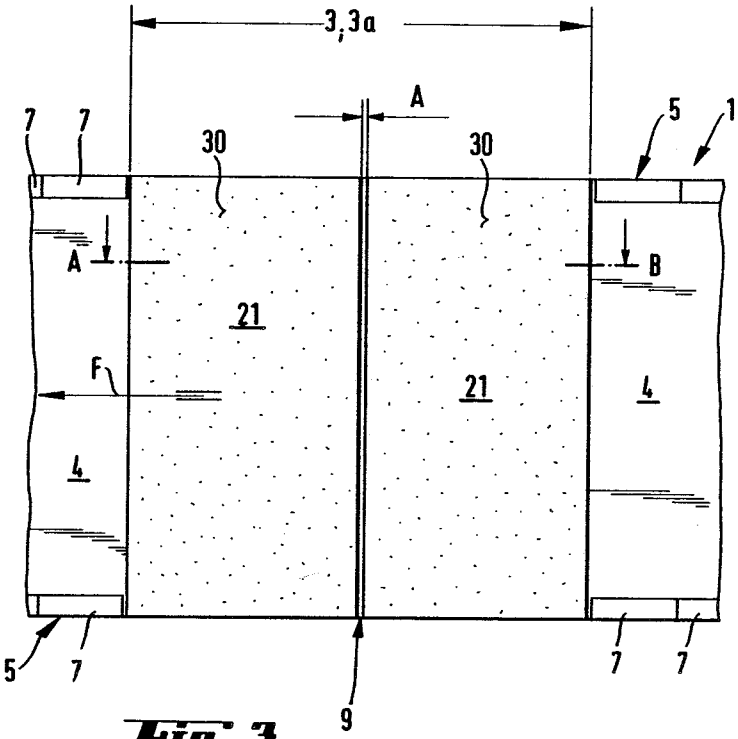
FIG. 3 is a view similar to FIG. 2 of another embodiment of the ski according to the invention.

The embodiment shown in FIG. 3 differs from the one in FIG. 2 in that the elements 21 having the glide surfaces 30 are carried through the area of the edging 5, and thus constitute the edging in the area of the glide zone 3, 3*a*.

Figure 4:
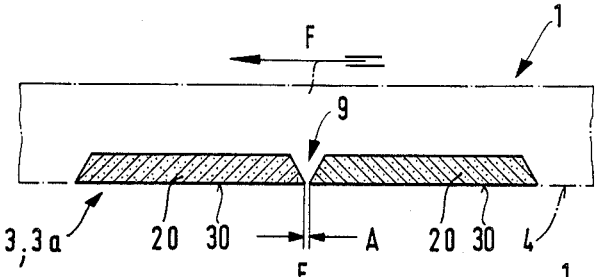
FIGS. 4 to 9 are cross sections taken along line A–B of FIG. 2 of arrangements of elements represented in different forms.

In FIG. 4, elements 20 are in the form of sintered compacts of trapezoidal cross section for an inlaid installation. The arrangement shown results in a junction 9 forming a V-shape with the ski 1, thereby preventing, in an especially appropriate manner, any friction between the elements 20 when the ski 1 is flexed. Glide surfaces are identified in FIG. 4 and in the following figures by the number 30.

Figure 5:
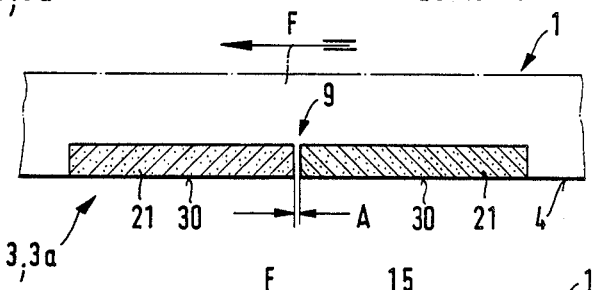

FIG. 5 also shows elements 21 in the form of sintered compacts, but of rectangular cross section.

Figure 6:
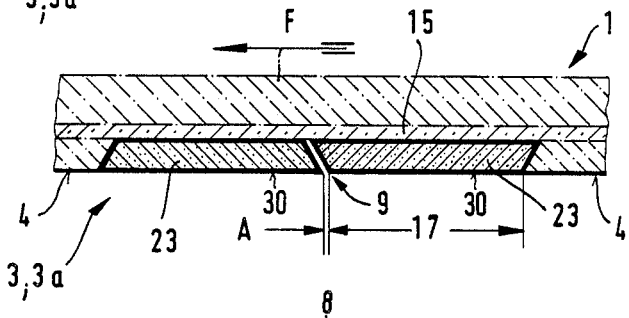

FIG. 6 again shows elements 23 in the form of sintered compacts of trapezoidal cross section, but they are so disposed that one of the elements has only its smaller base surface 17 associated with the glide zone so as to have a larger area in contact with the layer 15 above it, of the ski 1.

Figure 7:
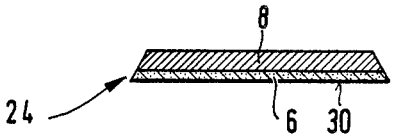

The embodiment shown in FIG. 7 has an element 24 preferably comprising a metal base plate 8 and a coating preferably comprising a titanium compound which serves to form the glide surface 30.

Figure 8:
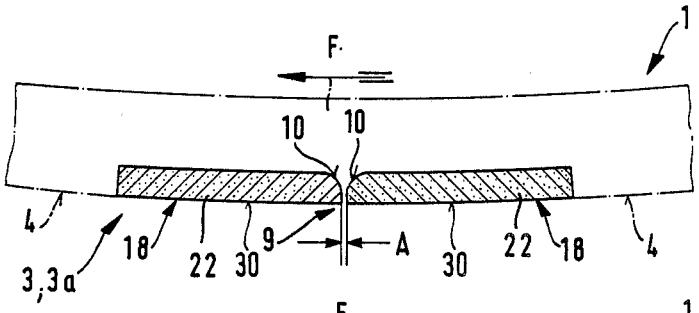

FIG. 8 showns elements 22 with rounded edges adjacent the junction 9; the elements 22 are rounded at their bottom 18.

Figure 9:
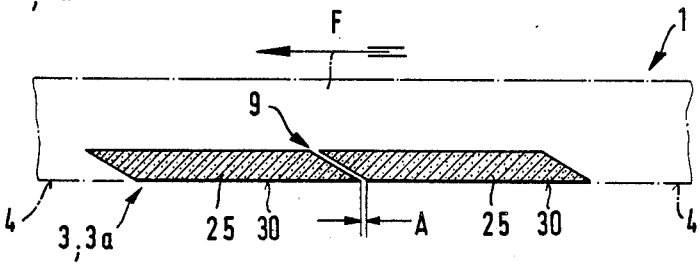

FIG. 9 shows elements 25 of parallelepipedal cross section.

Figure 10:
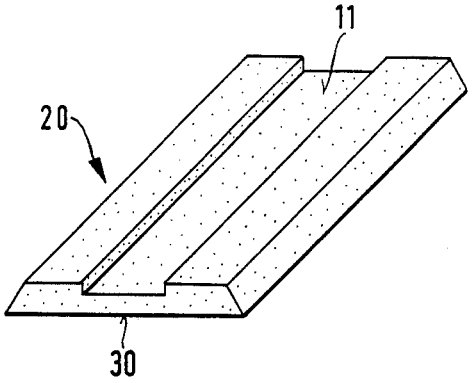
FIGS. 10 to 13 are perspective views of elements which can be joined to the ski by cementing or in a form-locking manner.
Figure 11:
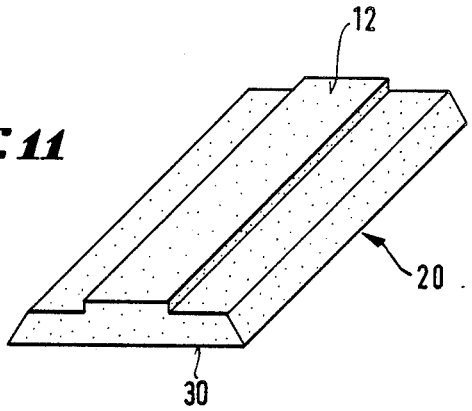
Figure 12:
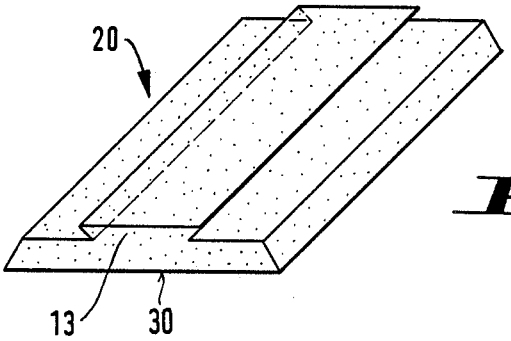

FIGS. 10 to 12 show embodiments of elements 20 having profiles at right angles to the direction of travel 5, which improve the joining between the ski 1 and the element 20.

The element 20 represented in FIG. 10 is provided with a groove 11 to achieve an especially good cement bond.

On the other hand the element 20 shown in FIG. 11 has a raised portion 12 which also serves to achieve an especially good cement bond.

FIG. 12 shows an element 20 having a dovetail 13.

Figure 13:
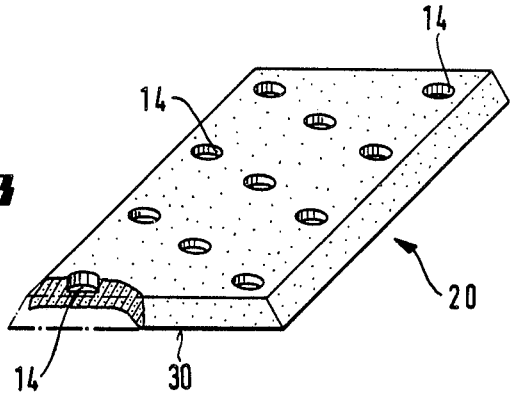

FIG. 13 shows an element 20 which has recesses 14 in its surface opposite that forming the glide zone, which serve to hold cement and thus form an especially reliable, form-locking bond to the layer of the ski that is above it.

The examples described above do not limit the invention to the embodiments described. For example, both an element made by coating a metal base plate with a titanium compound or ceramic material according to the invention and an element in the form of a sintered compact can be made in a variety of cross-sectional configurations, i.e., in a trapezoidal, rectangular, or parallelepipedal cross section or with rounded edges, and at the same time can be provided, at its surface opposite that forming the glide zone, with or without grooves, studs, dovetailing, recesses, or other such configurations.

While there have been described what are at present considered to be the preferred embodiments of this invention, it will be obvious to those skilled in the art that various changes and modifications may be made therein without departing from the invention, and it is, therefore, aimed to cover all such changes and modifications as fall within the true spirit and scope of the invention.

What is claimed is:

1. A ski having a tread along its lower surface, comprising:

forward and rearward glide zones which contact the ground when the ski is in an unloaded condition;

two or more elements which are in the form of solid ceramic sintered compacts cemented in the tread of the ski within each of said glide zones;

each of said solid ceramic sintered compacts having a width substantially the same as the entire width of the ski and extending longitudinally within each of said glide zones, wherein said solid ceramic sintered compacts within each of said glide zones are spaced apart longitudinally a distance of 0.2 mm to 0.4 mm, measured at the tread.

2. A ski according to claim 1, in which said solid ceramic sintered compacts are in the form of film with a thickness of 0.5 to 1.5 mm.

3. A ski according to claim 2, in which the sintered compacts in the form of film have a thickness of 0.8 to 1.2 mm.

4. A ski according to claim 2, in which the sintered compacts in the form of film are made from a mass consisting essentially of a temporary organic binding agent and otherwise of at least one material selected from the group consisting of aluminum oxide, zirconium oxide, silicon carbide, silicon nitride and silicon aluminum oxynitride, by forming, burning out the organic binding agent, sintering, and grinding.

5. A ski according to claim 1, in which the elements have a length of 65 to 95 mm each.

* * * * *

UNITED STATES PATENT AND TRADEMARK OFFICE

CERTIFICATE OF CORRECTION

PATENT NO. : 4,813,699

DATED : March 21, 1989

INVENTOR(S) : Wolfgang Burger, et al.

It is certified that error appears in the above-identified patent and that said Letters Patent is hereby corrected as shown below:

Column 2, line 45 for "material" read -- materials --.

Column 6, line 34 after "each" and before the period "." insert -- along the longitudinal direction of the ski --.

Signed and Sealed this

Ninth Day of October, 1990

*Attest:*

HARRY F. MANBECK, JR.

*Attesting Officer*

*Commissioner of Patents and Trademarks*